US005755224A

United States Patent [19]

Good et al.

[11] Patent Number: 5,755,224

[45] Date of Patent: May 26, 1998

[54] CYLINDER-MOUNTED OXYGEN MANAGEMENT DEVICE

[75] Inventors: Gregory W. Good, Fairhope, Pa.; Richard L. Dalton, Jr., Howell; Jon Peter Gilchrist, Livonia, both of Mich.

[73] Assignee: Sunrise Medical HHG Inc., Longmont, Colo.

[21] Appl. No.: 651,273

[22] Filed: May 23, 1996

[51] Int. Cl.[6] ..... A62B 7/00

[52] U.S. Cl. ..... 128/205.24; 128/204.18; 128/204.23; 128/207.12

[58] Field of Search ..... 128/205.24, 204.26, 128/204.28, 204.18, 202.27, 207.12, 207.16, 204.23, 204.24

[56] References Cited

U.S. PATENT DOCUMENTS

| | | | |
|---|---|---|---|
| 1,940,135 | 12/1933 | Luchs | 128/204.18 |
| 4,461,293 | 7/1984 | Chen | 128/204.23 |
| 4,519,387 | 5/1985 | Durkan et al. | 128/204.23 |
| 4,798,203 | 1/1989 | Bartos | 128/205.24 |
| 4,944,292 | 7/1990 | Gaeke et al. | 128/204.18 |
| 4,971,049 | 11/1990 | Rotariu et al. | 128/204.21 |
| 4,996,982 | 3/1991 | Williamson | 128/205.24 |
| 5,005,570 | 4/1991 | Perkins | 128/204.23 |
| 5,411,059 | 5/1995 | Sever et al. | 128/205.24 |

OTHER PUBLICATIONS

Brochure on the PulseDose Portable Compressed Oxygen Systems, DeVilbiss Division of Sunrise Medical, 1994.

*Primary Examiner*—Aaron J. Lewis
*Assistant Examiner*—V. Sewastava
*Attorney, Agent, or Firm*—MacMillan, Sobanski & Todd

[57] ABSTRACT

An oxygen management device adapted to mount on a post on a compressed oxygen cylinder. The device includes a manifold block which is attached to the oxygen cylinder post. A pressure regulator is mounted directly on and is integral with the manifold block for reducing the oxygen pressure to a desired level. The manifold block also mounts an overpressure relief valve, a solenoid operated flow control valve, a bypass valve, a continuous flow restrictor and a pressure gauge. The manifold and the components mounted thereon, a control circuit and a battery for operating the control circuit are mounted in an annular housing which has a central opening for receiving the oxygen cylinder post. The control circuit senses when a patient inhales in a nasal cannula and opens the flow control valve to deliver a predetermined dose of oxygen to the nasal cannula at the beginning of inhalation. The volume of the low pressure oxygen passages in the manifold block are minimized to enhance the responsiveness of the device in delivering a dose of oxygen to a patient.

7 Claims, 3 Drawing Sheets

CYLINDER-MOUNTED OXYGEN MANAGEMENT DEVICE

TECHNICAL FIELD

The invention relates to portable supplemental medical oxygen systems of the type which includes a compressed oxygen cylinder and more particularly to a gas management device for mounting on a compressed oxygen cylinder for controlling the delivery of supplemental oxygen to an ambulatory patient.

BACKGROUND ART

As the number of aged people in the population increases, there is an increasing number of people who require supplemental oxygen therapy. Many of these people are ambulatory and are capable of leaving the home and hospital. However, they require a portable source of supplemental oxygen in order to remain mobile. In the most basic supplemental oxygen system, compressed oxygen from a tank is supplied to the ambulatory patient through a pressure reducing regulator and a tube connected to a nasal cannula. The difficulty with the basic system is that the oxygen flow must be continuous. This results in an unnecessarily high oxygen consumption. Either the mobile time is severely limited or the patient must carry or push a heavy large capacity oxygen cylinder. The wasted oxygen also increases the expense of oxygen therapy.

Since the normal breathing pattern is to inhale about one-third of the time and to exhale and pause about two-thirds of the time, the constant flow gas delivery devices waste more than two-thirds of the oxygen since the oxygen is delivered to the patient during the exhalation portion of the breathing cycle in addition to the inhalation portion of the cycle. In addition, it has been recognized that a patient's airway includes significant dead air space between the mouth and nose and the oxygen adsorbing portions of the lungs. Only oxygen in the portion of the respiratory gas which reaches the alveoli is absorbed. This oxygen is in the leading portion of the flow of respiratory gas when the patient initially begins to inhale. One recent trend in the design of portable respiratory oxygen management systems is a pulse-type flow controller which delivers a fixed volume or bolus of the respiratory gas only at the initiation of a patient's inhalation cycle. The gas savings permits smaller and lighter portable oxygen systems with increased operating time. An exemplary prior art oxygen flow controller is shown, for example, in U.S. Pat. No. 4,461,293.

The pulse-type gas flow controllers typically use a sensor to determine when the initial point of inhalation occurs. Upon sensing the initiation of inhalation, the device opens a valve to deliver a short, measured dose of oxygen at the leading edge of the inhalation cycle. Since all of this dose finds its way deep into the lungs, less oxygen is required to accomplish the same effect than with the more wasteful continuous flow delivery method. Therefore, with the pulsed delivery method, the respiratory gas supply is conserved while still providing the same therapeutic effect. Typically, an oxygen supply with a pulse flow controller will last two to four times longer than a similarly sized continuous flow oxygen supply.

The pulse-type gas management devices function to deliver the respiratory gas on demand. More specifically, as the respiratory rate, in terms of breaths per minute, increases, the patient actually receives more respiratory gas over the same period of time. Pulse-type gas management devices commonly include means for preventing overdosing of the patient with the respiratory gas. The overdosing-prevention means may be a circuit which allows only a predetermined amount of doses, for example 40 doses, to be delivered over a one minute period. This may be accomplished by requiring a minimum time delay between administration of successive doses.

Another advantage of the pulse-type of gas management device is that it is more comfortable to use. By releasing the supplemental oxygen only while the patient is inhaling, the constant blowing of oxygen into the patient's nostrils is eliminated. The dry supplemental oxygen is delivered only during the early stages of inhalation. The remaining portion of the inhalation gas consists of ambient air. Moisture in the ambient air maintains the nasal cavity at a more normal moisture level.

While the pulse-type delivery method has several advantages over the continuous-type delivery method, there are still instances when the user will require a continuous dose from their portable device. For this reason, most of the gas management devices have a user-operated valve for selecting between the pulse dose or continuous flow. This also permits continuation of oxygen therapy in the event that the pulse flow controller should fail.

A number of portable compressed oxygen systems with flow controllers are known. Typically, a pressure regulator is attached to the oxygen cylinder to reduce the high tank pressure to a predetermined low pressure, such as to between 20 and 50 psig. Flexible tubing connects the regulator to a flow control valve, to a pressure sensor and to a bypass valve for continuous flow operation. The connections are possible sources of leaks and/or of failures. Further, the volumetric capacity of the pneumatic connections in the flow controller may create a small delay in the delivery of an oxygen pulse when the flow control valve is opened because the response time of the device is necessarily dependent on the total gas volume. It is desirable to minimize this volume so as to provide a device having the fastest response time possible. It also would be desirable to eliminate the tube connections between a number of components in a gas management device.

DISCLOSURE OF INVENTION

According to the invention, a manifold block in a respiratory gas management device is designed to be attached directly to a post on an oxygen cylinder. The manifold block includes internal gas passages for delivering oxygen from the cylinder to a fitting to which one end of an oxygen delivery tube is secured. A nasal cannula is attached to the other end of the tube. A pressure regulator is mounted directly in the manifold block for reducing the cylinder pressure to a predetermined level, such as to 50 psig. The manifold block also includes at least two valves. A solenoid actuated valve is provided for delivering controlled doses of oxygen to the patient. In addition, the manifold includes a flow restrictor connected in series with a bypass valve. When a manual knob is operated to open the bypass valve, the solenoid actuated valve is bypassed to provide a continuous flow of oxygen to the patient. Preferably, the flow restrictor is adjustable to permit setting the continuous flow rate.

The gas management device is provided with an annular housing which enclosed the manifold. The housing has a central opening which receives the main valve post on the oxygen cylinder. A knob or handle on one side of the housing is used to secure the device to the oxygen cylinder post. The housing also encloses conventional electronics for sensing the pressure drop caused when the patient begins to inhale and for opening the solenoid controlled valve to deliver a pulse or bolus of oxygen to the patient. The size of the bolus will be determined by the set oxygen pressure, the time that the solenoid valve remains open and the size of the oxygen flow passages between the oxygen cylinder and the patient.

Accordingly, it is an object of the invention to provide an improved gas management device for supplying supplemental oxygen to an ambulatory patient.

Other objects and advantages of the invention will become apparent from the following detailed description of the invention and the accompanying drawings.

BEST MODE FOR CARRYING OUT THE INVENTION

Figure 1:
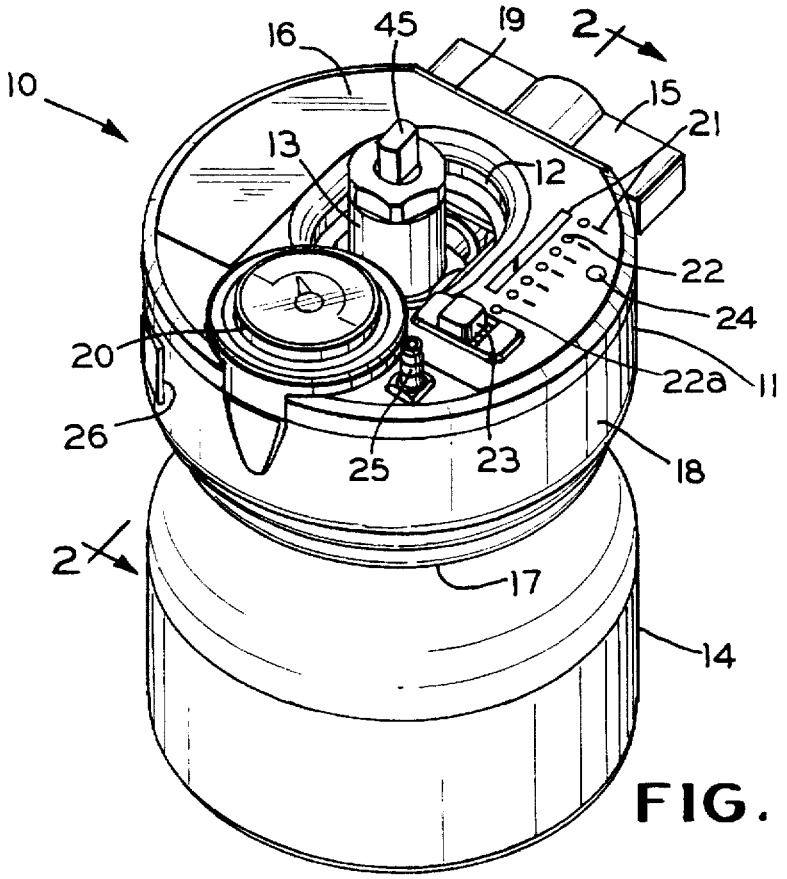
FIG. 1 is a front perspective view of a compressed gas cylinder fitted with a gas management device according to the invention.
Figure 2:
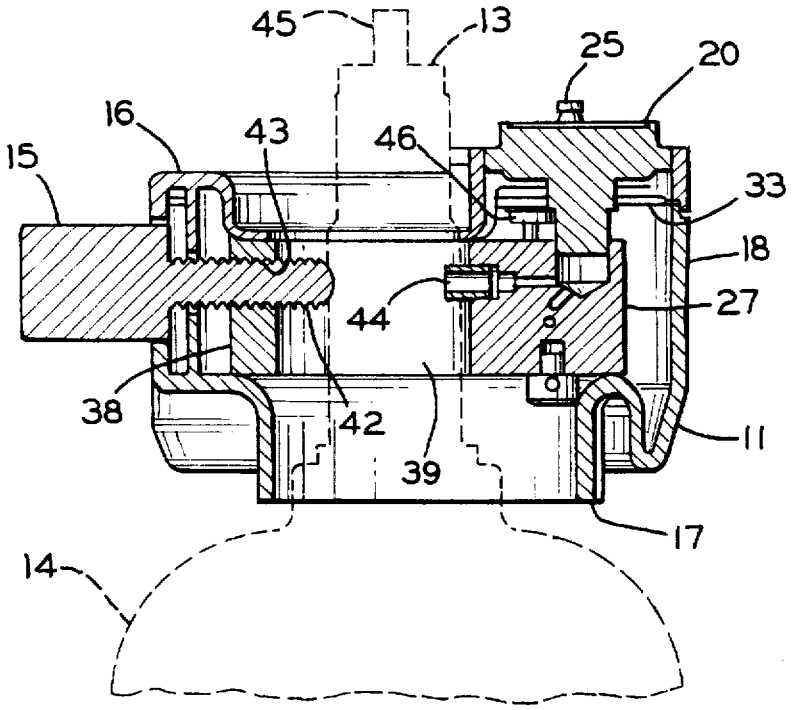
FIG. 2 is an enlarged fragmentary cross sectional view as taken along line 2—2 of FIG. 1.
Figure 3:
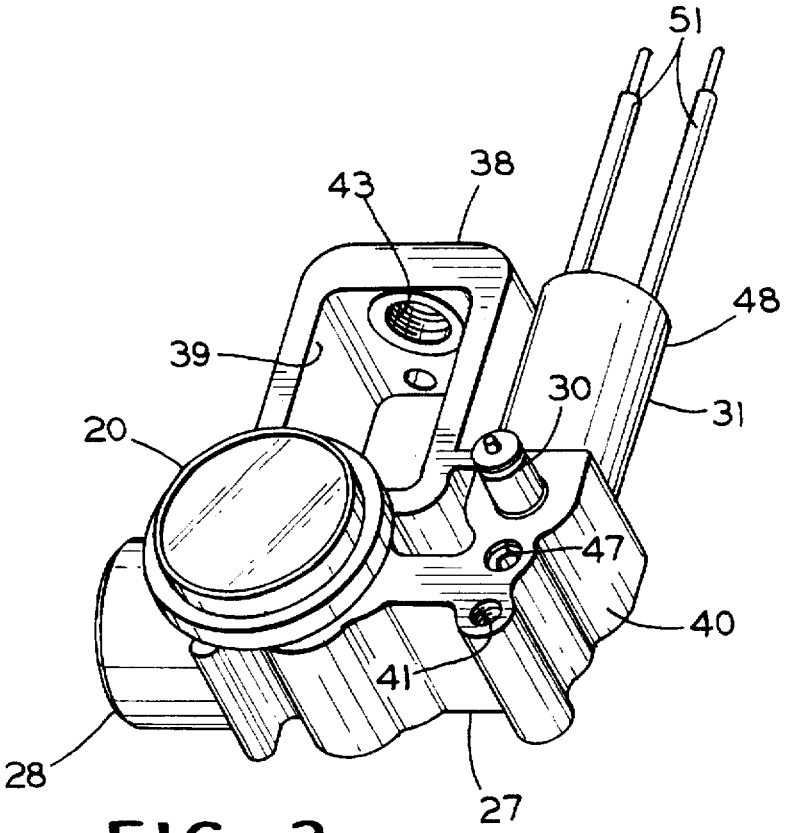
FIG. 3 is an enlarged front perspective view of a manifold block for the gas management device of FIG. 1.
Figure 4:
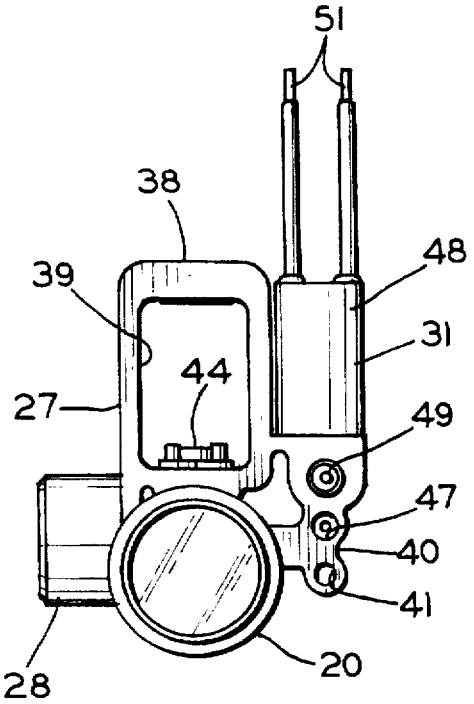
FIG. 4 is a front view of the manifold block of FIG. 3.
Figure 5:
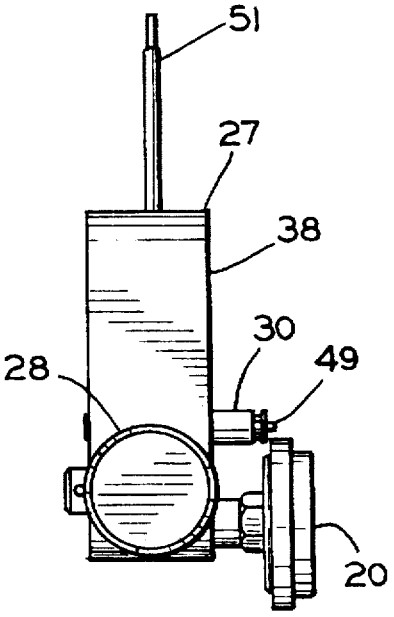
FIG. 5 is a left side view of the manifold block of FIG. 3.

Referring now to the drawings, FIGS. 1 and 2 show a gas management device 10 in accordance with the present invention. The gas management device 10 has a generally annular shaped housing 11 with a center opening 12 which is configured to fit over a post 13 of an oxygen cylinder 14. A "T" shaped handle 15 projects from the housing 11 and may be manually rotated for releasably securing the device 10 to the oxygen cylinder 13. It will be appreciated that other handle shapes also may be provided.

The components of the gas management device 10 are contained within the housing 11. The annular housing 11 includes a top face 16, a bottom 17, and a cylindrical side 18. As used herein, the relative terms "top", "bottom", "left" and "right" refer to the orientation of the device 10 and any of its individual components when the device 10 is mounted on top of the oxygen cylinder 14 in the orientation shown in FIG. 1. The cylindrical housing side 18 has a flat portion 19 which provides clearance for the handle 15 to be turned to secure the gas management device 10 to, and to remove it from, the oxygen cylinder post 13. As shown in FIG. 1, several indicating devices are located at the top face 16 of the device 10. These may include a pressure gauge 20 and a row of LED indicators 22 with one or more adjacent scales 21 to identify the data displayed by the indicators 22. In addition, several controls are supported on the top face 16 including a continuous/pulse mode valve control knob 23 and a function selector switch 24. A barbed fitting 25 projects from the top face 16 for connection to a tube (not shown) which in turn connects to a conventional nasal cannula (not shown) for delivering the oxygen to the patient. The indicating devices and controls will be discussed in detail below. An access door 26 is located on the cylindrical side 18 for replacing a battery which powers the device 10.

The housing 11 is preferably molded from a lightweight and durable material, such as a plastic. It is preferred that the material used for the housing 13 also have flame retardant characteristics since it may be exposed to high oxygen concentration gas. One suitable material which meets these criteria is an ABS such as Cycolac KJW manufactured by General Electric Company. ABS is the material of choice because of its flame retardancy and excellent impact properties.

As noted above, the components which comprise the gas management device 10 of the present invention are contained within the housing 13. These components are shown in detail in FIGS. 2 through 8 and include a manifold block 27, a pressure regulator 28, a pressure relief valve 29, the pressure gauge 20, a manually operated bypass valve 30, a solenoid-operated flow control valve 31, a manually adjustable constant flow limiting valve or flow restrictor 32, a printed circuit board 33, and a battery (not shown). As will be discussed in greater detail below, many of these components are integral with the manifold block 27 and are therefore, in fluid communication with each other through a plurality of internal passageways in the manifold block 27. Therefore, an advantage of the gas management device 10 is that no tubing or tubing connectors are used within the device 10. The only tubing and connectors used is external to the device 10 in conjunction with delivering oxygen from the device 10 to a nasal cannula worn by the patient.

Details of the manifold block 27 of are shown in FIGS. 2–6. The manifold block 27 includes a generally rectangular section 38 surrounding a center opening 39 and an irregular shaped section 40. The rectangular section 38 is used for attaching the device 10 to the gas cylinder post 13 and for connecting the device 10 to the gas supply through a suitable connection interface. The manifold block section 40 includes most of the components used for controlling the flow of gas from the gas cylinder 11 to the cannula fitting 25 which is attached to the manifold block at a threaded outlet port 41. Because the manifold block 27 will be in contact with high pressure oxygen, the manifold block 27 should be constructed from a material which can withstand the high pressures. Materials suitable for use in constructing the manifold block 27 include, but are not limited to, aluminum or brass. In a preferred embodiment, the manifold block 27 is made from an aluminum extrusion which is cut into lengths to form individual manifold blocks.

As noted above, the rectangular section 38 of the manifold block 27 is used for securing the device 10 to the gas cylinder 14. More specifically, the gas cylinder post 12 is received in the center aperture 39 through the manifold block section 38 and the device 10 is secured to the post 12 by rotating the "T" shaped handle 15 to screw an attached threaded post 42 into a threaded opening 43 in the rectangular section 38. Within the opening 39 opposite the threaded opening 43, the manifold 27 is provided with a fitting or connection 44 which is configured to mate with and seal to an oxygen outlet connection on the cylinder post 13. The cylinder post may be provided with various standard connection configurations, for example, with a conventional CGA 870 connection. The oxygen cylinder post 13 includes a valve 45 which is operated with a suitable wrench (not shown) to allow pressurized oxygen to flow from the cylinder 14 to the manifold 27.

As noted above, the primary components used for controlling the flow of gas from the gas cylinder 11 to the cannula fitting 25 are located within or mounted on the manifold block section 40. The pressure regulator 28 which reduces the relatively high pressure of the gas from the gas cylinder 11 to a relatively low operating pressure is constructed as an integral part of the manifold block 27. The pressure regulator 28 may be of a conventional design. In a preferred embodiment of the invention, the pressure regulator 28 is designed to function with compressed oxygen having a pressure of up to about 3000 psig and to reduce this pressure to an operating pressure of about 50 psig.

Figure 6:
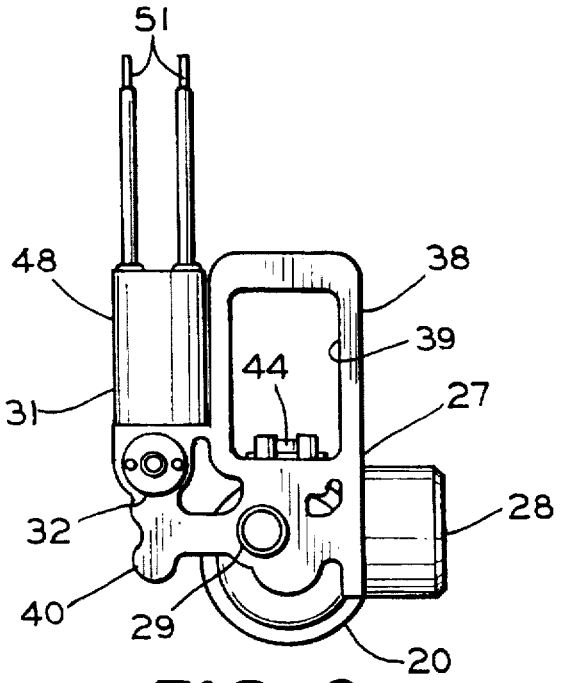
FIG. 6 is a rear view of the manifold block of FIG. 3.

Two additional pressure-related components integral with the manifold block 27 are the pressure relief valve 29 and the pressure indicator gauge 20. The pressure relief valve 29 is best seen in FIG. 6 and is used to limit the operating pressure of the device 10 set by the pressure regulator 28 to a predetermined maximum safe level. For example, if the pressure regulator 28 functions to maintain the operating pressure of the device 10 at about 50 psig, then the pressure relief valve 29 may be designed to limit this pressure to no greater than 60 psig. In essence, the pressure relief valve 29 functions as a backup safety device to the pressure regulator 28. If the pressure regulator 28 fails to maintain the operating pressure in the device 10 at a safe operating value such that the pressure begins to increase, the pressure relief valve 29 will open to vent excessive oxygen pressure. The gauge 20 indicates the actual oxygen cylinder pressure upstream from the pressure regulator 28.

As best seen in FIG. 2, a pressure sensor 46 is mounted on the printed circuit board 33 and connects to a port 47 (FIG. 3) on the manifold section 40. The pressure sensor 46 senses the reduced oxygen pressure in the manifold section 40 when the patient inhales and generates an electrical a signal indicative thereof. The pressure signal from the pressure sensor 46 is used by a microprocessor (not shown) located on the printed circuit board 33 to determine when a pressure drop occurs as a result of patient inhalation. The microprocessor will respond to the detection of inhalation by activating a solenoid 48 to open the flow control valve 31 and deliver a bolus of oxygen to the patient. The pressure signal also may be used by the microprocessor to activate an audible warning that the pressure in the gas cylinder is low, and therefore, the gas cylinder should be recharged.

In addition to the pressure controlling components, the manifold section 40 includes several other integral components. The bypass valve 30 is connected to bypass the flow control valve 31 to selectively supply a continuous flow of oxygen to the patent. The flow limiting valve 32 is connected in series with the bypass valve 30 to establish the rate of oxygen flow when the bypass valve 30 is open. The flow limiting valve 32 may be a manually adjustable needle valve which is set to the desired constant flow rate. Alternately, the flow limiting valve 32 could be replaced with a fixed orifice flow restrictor. Although it is more economical to operate a device 10 in a pulse mode during which oxygen is supplied in pulsed doses only when inhalation is sensed, there are situations in which the patient may desire to be supplied with a constant flow rate of gas. The knob 23 controls the bypass valve 30 and is used for manually selecting between a pulsed flow mode or a continuous flow mode. If, for example, the battery power source for the device 10 fails, the patient may merely move the knob 23 to establish a continuous oxygen flow.

Figure 7:
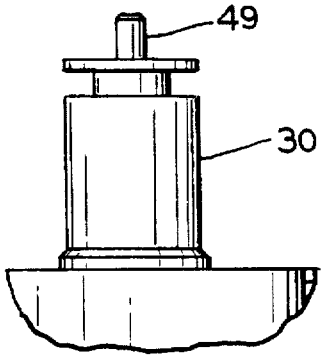
FIG. 7 is an enlarged fragmentary side view of the manifold block showing details of the bypass valve.
Figure 8:
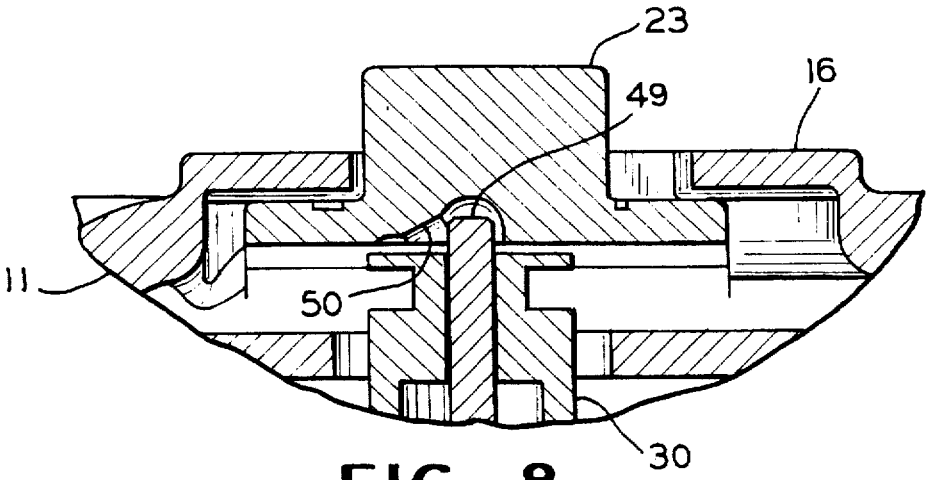
FIG. 8 is an enlarged fragmentary cross sectional view showing details of the actuator knob for the bypass valve of FIG. 7.

Details of operation of the bypass valve 30 are shown in FIGS. 7 and 8. The bypass valve 30 has an extended valve stem 49. The valve 30 is operated by pushing and releasing the valve stem 49. When the knob 23 is in the position illustrated in FIG. 8, the valve stem 49 is extended. When the knob 23 is moved to the right in FIG. 8, a sloping lower cam surface 50 pushed the valve stem 49 into the valve 30. Thus, the knob 23 moves the valve stem 49 between two distinct positions. In one of the two positions of the valve stem 49, the valve 30 is closed and oxygen flows to the patient only when the flow control valve 31 is opened. In the other position of the valve stem 49, the bypass valve 30 is open and oxygen can flow continuously around the flow control valve 31. When the bypass valve 30 is open, for example, oxygen can flow to the patient at a continuous rate in the range of about 1 liter per minute to about 8 liters per minute, as established by the flow limiting valve 32.

The solenoid 48 functions to open the flow control valve 31 in response to a signal from the printed circuit board 33. The solenoid 48 is powered by a suitable battery and is connected to the printed circuit board 33 using leads 51. The power requirements for the solenoid 48, the microprocessor, and indicators 22 in the device 10 may be relatively small. Therefore, a low voltage battery will be suitable for operating the device 10. Because the battery will have only a finite amount of life before it will need to be replaced or recharged, it is desirable to allow the indicator 21 to indicates the life remaining in the battery.

When the gas management device 10 is operated in the pulse mode, the amount of the pulsed flow rate is set using the function selector switch 24. The device 10 may be controlled to selectively provide a number of discrete effective flow rates. These flow rates may be indicated by the LED indicators 22 as the corresponding continuous flow rates that provide the same therapeutic effects as the pulse doses. Alternatively, any analog or digital indicating means could be used. In a preferred embodiment, effective flow rates in the range of about 0.5 liters per minute to about 6 liters per minute may be selected, although a different range may be provided.

Preferably, the function switch 24 is a push button switch which is connected to the microprocessor controller. If the device 10 is not in use for a preset period of time, it automatically enters a sleep mode to conserve power. A push of the switch 24 wakes the device 10 from the sleep mode. The microprocessor may be programmed to give different responses to operation of the switch 24 while it is awake. For example, if the switch 24 is pushed once, the LED's 22 may be briefly illuminated to indicate the remaining batter life on a scale 21 illustrated to the left of the LED's 22. With a longer remaining life, more of the LED's 22 may be illuminated. If the function switch 24 is pushed and held for 5 seconds or more, one of the LED's 22 will blink to indicate on a scale 21, as illustrated to the right of the LED's 22, the set effective pulse flow rate. Each LED 22 represents a different effective pulse flow rate. When in this mode, each push of the switch 24 increments the pulse flow rate to the next level. When the switch 24 is not pushed for a period of time, the LED's 22 are turned off to conserve battery life. A separate LED **22*a*** may be provided to indicate when the battery is low. This LED will remain constantly illuminated in response to a low battery.

The solenoid 38 for the pulse mode flow control valve 31 may be actuated by a microprocessor or other known control circuit (not shown) which is located on the printed circuit board 33. The printed circuit board 33 is also contained within the housing 11 and preferably is located between the manifold block 27 and the top housing face 16. The microprocessor receives a signal from the pressure sensor 46 and determines when and for how long a pulse of oxygen is to be delivered to the patient. When gas is not flowing through the manifold block 27 to the outlet port 41, the pressure sensor 46 is in fluid communication with the patient's nasal cavity via the connected tube and nasal cannula. The sensor 46 will sense a pressure drop when the patient initially inhales. Upon detecting the pressure drop, the microprocessor actuates the solenoid 48 which in turn opens the flow control valve 31. The flow control valve 31 will be held open for a time determined by the selected flow rate. Thus, if the selected flow rate is doubled, the valve 31 will be held open approximately twice as long for each bolus or dose of oxygen. This process is repeated every time the patient begins to inhale, unless the microprocessor determines that too much gas is being demanded by the patient. In this case, the microprocessor may be programmed to prevent overdosing the patient by requiring a minimum time interval between each successive oxygen dose.

The total volume of the air passages in the manifold section 40 downstream from the pressure regulator 28 device is on the order of less than about 0.10 cubic inch (1.6 cc). More preferably, the total volume is about 0.08 cubic inch (1.28 cc). The apparent result of designing the manifold 27 with such a low total volume is that the overall response time of the device 10 is quicker as compared to other devices using internal and external tubing and external pressure related devices. In the past, the pressure regulator was separate from the flow control valve and the flow bypass valve was separate from the flow control valve. Consequently, the valves and the related connections resulted in a relatively large air space which slow up the oxygen pulse delivery time. A quicker response time is clearly advantageous to the patient because the bolus of gas is supplied to the patient when it is most needed—closer to the beginning of each inhalation cycle.

A number of the valves and components have been described as being integral with the manifold block 27. As used herein, the term "integral" means that the components are at least mounted directly on the manifold block 27 and in some cases may share common components with the manifold block 27. For example, a valve seat may be machined directly in the manifold block 27, while other components of the valve may be mounted on the manifold block 27.

It will be appreciated that various modifications and changes may be made to the above described preferred embodiment of a gas management device without departing from the scope of the following claims.

We claim:

1. An oxygen management device adapted to be mounted on a post on a compressed oxygen cylinder for delivering a controlled flow of oxygen to a patient comprising a manifold block having an opening adapted to receive a post on an oxygen cylinder, said manifold block opening having an oxygen connection adapted to engage and seal to a mating connection on an oxygen tank post, means for securing said manifold block to an oxygen cylinder post received by said opening, pressure regulating means on said manifold block for reducing the pressure of oxygen received from a cylinder to a predetermined low level, an overpressure relief valve on said manifold block, a solenoid operated flow control valve on said manifold block arranged for initiating and interrupting the delivery of oxygen from the cylinder to a patient, a bypass valve on said manifold arranged in parallel with said solenoid operated flow control valve, flow restricting means in series with said bypass valve to limit oxygen flow through said bypass valve, means for manually opening and closing said bypass valve, and control means responsive to inhalation by a patient for opening said solenoid operated flow control valve to deliver a dose of oxygen to a patient.

2. An oxygen management system, as set forth in claim 1, and further including an annular housing enclosing said manifold block, said pressure regulating means, said overpressure relief valve, said solenoid operated flow control valve, said bypass valve, said flow restrictor and said control means, and wherein said annular housing has an opening aligned with said manifold block opening and adapted to receive a post on an oxygen cylinder.

3. An oxygen management system, as set forth in claim 2, and further including an oxygen pressure gauge mounted on said manifold block and adapted to indicate the pressure of oxygen in said manifold block from an oxygen cylinder.

4. An oxygen management system, as set forth in claim 2, and further including a knob extending from said housing for movement between first and second positions, and means for opening said bypass valve when said knob is in said first position and for closing said bypass valve when said knob is in said second position.

5. An oxygen management system, as set forth in claim 4, wherein said bypass valve has a valve stem movable between open and closed positions, and wherein said valve stem is moved by said opening and closing means to said open position when said knob is moved to said first position and to said closed position when said knob is moved to said second position.

6. An oxygen management system, as set forth in claim 2, and further including means on said housing for selecting and indicating the effective pulse flow rate delivered to an inhaling patient by said solenoid operated flow control valve.

7. An oxygen management system, as set forth in claim 1, and wherein said manifold block includes a plurality of oxygen passages connecting said pressure regulating means, said overpressure relief valve, said solenoid operated flow control valve, said bypass valve, and said flow restricting means, and wherein said oxygen passages have a total volume of no greater than 0.1 cubic inch.

* * * * *